US008794728B2

(12) United States Patent
Nakano et al.

(10) Patent No.: US 8,794,728 B2
(45) Date of Patent: Aug. 5, 2014

(54) INK JET RECORDING APPARATUS

(75) Inventors: Takatoshi Nakano, Yokohama (JP); Kiichiro Takahashi, Yokohama (JP); Tetsuya Edamura, Inagi (JP); Akiko Maru, Tokyo (JP); Hirokazu Tanaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 13/553,454

(22) Filed: Jul. 19, 2012

(65) Prior Publication Data

US 2013/0021399 A1 Jan. 24, 2013

(30) Foreign Application Priority Data

Jul. 23, 2011 (JP) ..... 2011-161441

(51) Int. Cl.
*B41J 29/38* (2006.01)

(52) U.S. Cl.
USPC ..... 347/14; 347/9; 347/19

(58) Field of Classification Search
CPC ..... B41J 29/38
See application file for complete search history.

(56) References Cited

U.S. PATENT DOCUMENTS

| | | | | |
|---|---|---|---|---|
| 5,481,282 | A * | 1/1996 | Iwata | 347/30 |
| 6,474,774 | B1 * | 11/2002 | Okamoto | 347/32 |
| 7,404,614 | B2 * | 7/2008 | Usuda | 347/23 |
| 2008/0211860 | A1 * | 9/2008 | Yamaguchi et al. | 347/30 |
| 2009/0147038 | A1 * | 6/2009 | Tsukada | 347/14 |

FOREIGN PATENT DOCUMENTS

| | | | |
|---|---|---|---|
| JP | 2008-221655 | A | 9/2008 |
| JP | 2009-262353 | A | 11/2009 |

* cited by examiner

*Primary Examiner* — Manish S Shah
*Assistant Examiner* — Jeremy Delozier
(74) *Attorney, Agent, or Firm* — Canon USA, Inc., IP Division

(57) ABSTRACT

An inkjet recording apparatus includes a recording head, a cap, and a preliminary discharge unit. The recording head can discharge a plurality of types of ink. The cap caps a discharge port face of the recording head. The preliminary discharge unit causes the recording head to execute a preliminary discharge. The preliminary discharge unit changes a preliminary discharge operation according to a length of time during which the discharge port face is capped by the cap.

10 Claims, 7 Drawing Sheets

INK JET RECORDING APPARATUS

BACKGROUND OF THE INVENTION

1. Field of the Invention

The present invention relates to an ink jet recording apparatus that discharges an ink droplet from a recording head according to recording data and records an image on a recording medium.

2. Description of the Related Art

An ink jet recording apparatus records data by discharging ink in liquid form an extremely small nozzle. When recording is not performed, moisture in the ink in the nozzle evaporates and the viscosity of the ink rises. Then, the color materials in the ink may cohere. If recording is started in such a state, the discharge performance of the recording head may be declined due to non-discharge of ink or unstable discharge of ink.

Thus, prior to recording on a recording medium, a conventional ink jet recording apparatus preliminary discharges or suctions ink which has been thickened in the nozzle due to moisture evaporation.

Further, a cap that covers the surface of the recording head is provided for the recording apparatus. The cap is helpful in preventing a discharging defect due to drying and solidifying of the ink in the nozzle that occurs when printing is not performed for a certain time. However, the cap is generally made of a material such as normal rubber, and the cap itself transmits moisture. Thus, even if the recording head is capped, if the printing is not performed for a long time, the moisture in the ink in the nozzle gradually evaporates. As a result, a preliminary discharge operation or a suction operation will be necessary before the next recording operation is started.

Additionally, the ink jet recording apparatus of recent years has used ink of multiple colors and smaller-sizes nozzles due to expansion of color gamut, improvement in gradation characteristics, and reduction in granularity. As described above, even if the recording head is capped, evaporation of the moisture or the moisture absorption of ink of each color occurs. Moisture mole fraction of ink differs according to the color of the ink. In other words, some ink dries relatively quickly but some do not. Further, the discharging defect due to moisture evaporation of ink tends to occur with fine nozzles. Thus, it is necessary to perform the preliminary discharge operation and the suction operation more frequently compared to the conventional ink jet recording apparatus.

Japanese Patent Application Laid-Open No. 2009-262353 discusses a method according to which a preliminary discharge is performed in the cap before the capping operation. Such preliminary discharge is useful to maintain the humidity in the cap nozzle for a certain period of time, so that it does not fall below a tolerable lower limit of humidity at which the possibility of discharging defect increases. Further, by performing preliminary discharge of ink with higher mole fraction of water in the cap, the timing of a next recovery operation can be delayed.

However, according to the invention discussed in Japanese Patent Application Laid-Open No. 2009-262353, since the preliminary discharge of ink with high mole fraction of water is performed in the cap before the capping operation, even if a next record command is issued shortly after the capping operation, the ink with high mole fraction of water is discharged in the cap. Thus, unnecessary ink is discharged and the amount of waste ink is increased.

SUMMARY OF THE INVENTION

The present invention is directed to a recording apparatus that can realize high image quality recording without increasing the amount of waste ink and decreasing the ink discharge performance.

According to an aspect of the present invention, an inkjet recording apparatus includes a recording head configured to discharge a plurality of types of ink, a cap configured to cap a discharge port face of the recording head, and a preliminary discharge unit configured to cause the recording head to execute a preliminary discharge, wherein the preliminary discharge unit changes a preliminary discharge operation according to a length of time during which the discharge port face is capped by the cap.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The configuration of a first exemplary embodiment is described in detail below with reference to the drawings. The configurations of the exemplary embodiments are provided for exemplification purposes and should not be construed as limiting the scope of the invention. A recording apparatus, which is capable of preventing decline in ink discharge performance and realizing high image quality recording without increasing an amount of waste ink, includes a recording head configured to discharge a plurality of types of ink, a cap configured to cap a discharge port face of the recording head, and a preliminary discharge unit configured to cause the recording head to perform a preliminary discharge, and the preliminary discharge unit changes the preliminary discharge operation according to a length of time the discharge port face is capped by the cap.

Figure 1:
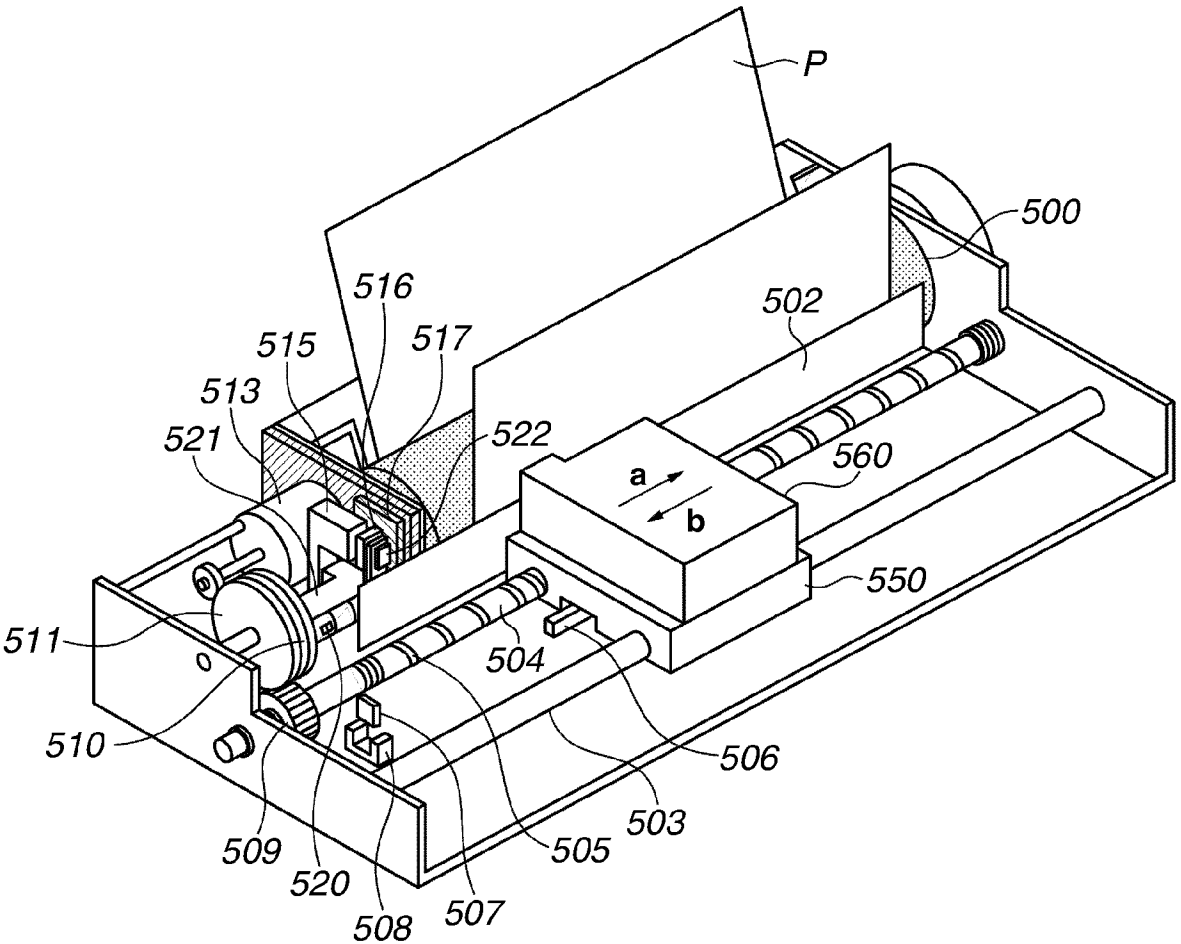
FIG. 1 is a perspective view of an overall configuration of an ink jet recording apparatus.

FIG. 1 is a perspective view of an overall configuration of an ink jet recording apparatus. A lead screw 505 rotates via driving force transmission gears 509 to 511 according to a drive of a main scanning motor 513 in forward and reverse directions. A pin (not illustrated) provided on a carriage 550 engages a helical groove 504 on the lead screw 505. The carriage 550 is supported by a guide rail 503. According to the rotation of the lead screw 505 by the main scanning motor 513, the carriage 550 reciprocally moves in the directions indicated by arrows "a" and "b". An ink cartridge 560, which includes a recording head and an ink tank, is mounted on the carriage 550.

A paper pressing plate 502 presses recording paper P against a platen 500 along the moving direction of the carriage 550. Photocouplers 507 and 508 are home position detectors that change the rotation direction of the main scanning motor 513 according to the detection of a lever 506 of the carriage 550.

A cap holder 516 supports a cap 522 that caps a discharge port face of a recording head. A suction device 515 suctions ink in the cap 522. A wiper 517 wipes the discharge port face of the recording head.

A lever 521 is used to start a suction operation of the recording head. The lever 521 moves in association with a movement of a cam 520, which engages the carriage 550. Further, the lever 521 is controlled according to the drive force of the main scanning motor 513 transmitted via a transmission mechanism.

Figure 2:
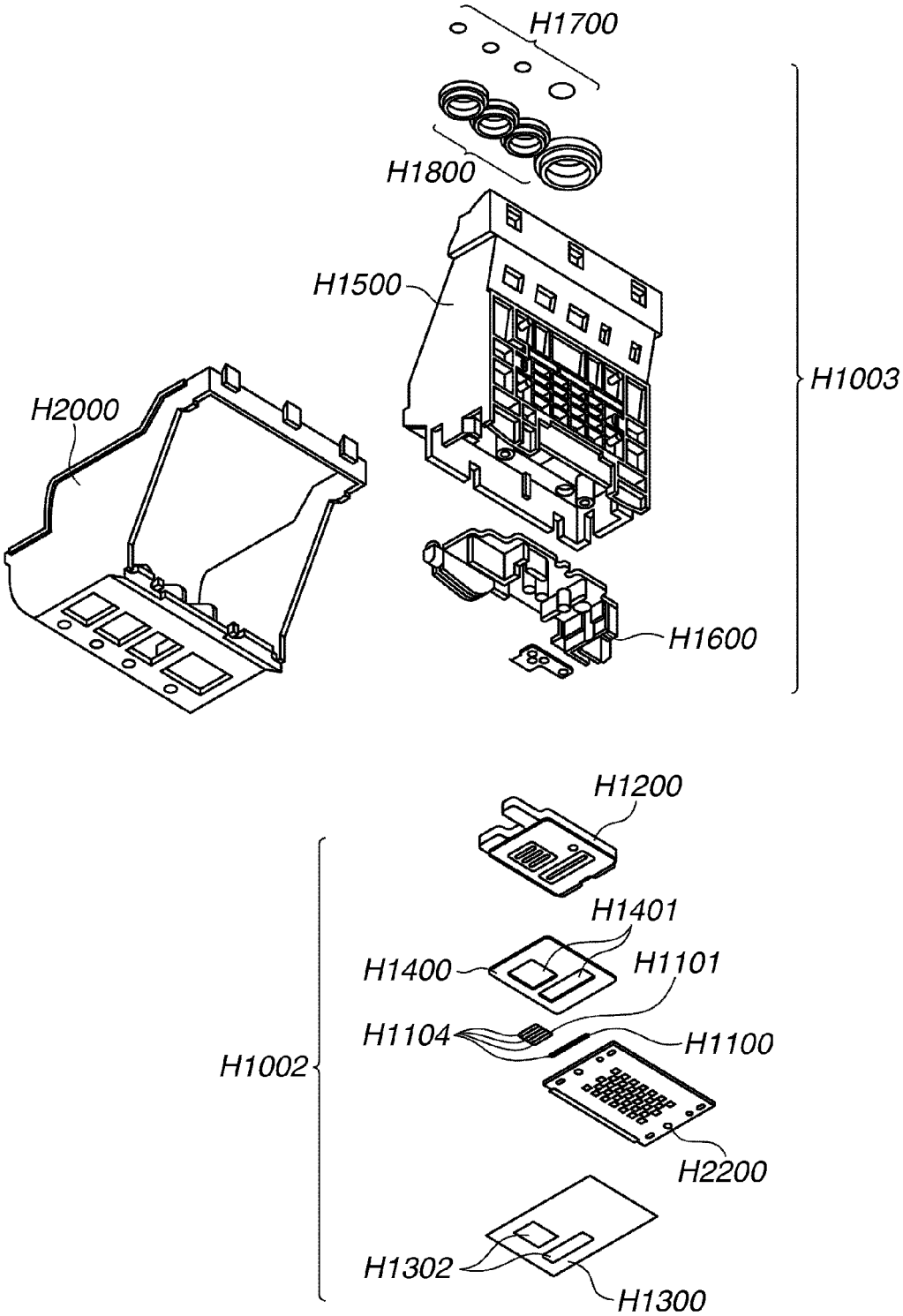
FIG. 2 is an exploded perspective view of a recording head.
Figure 3:
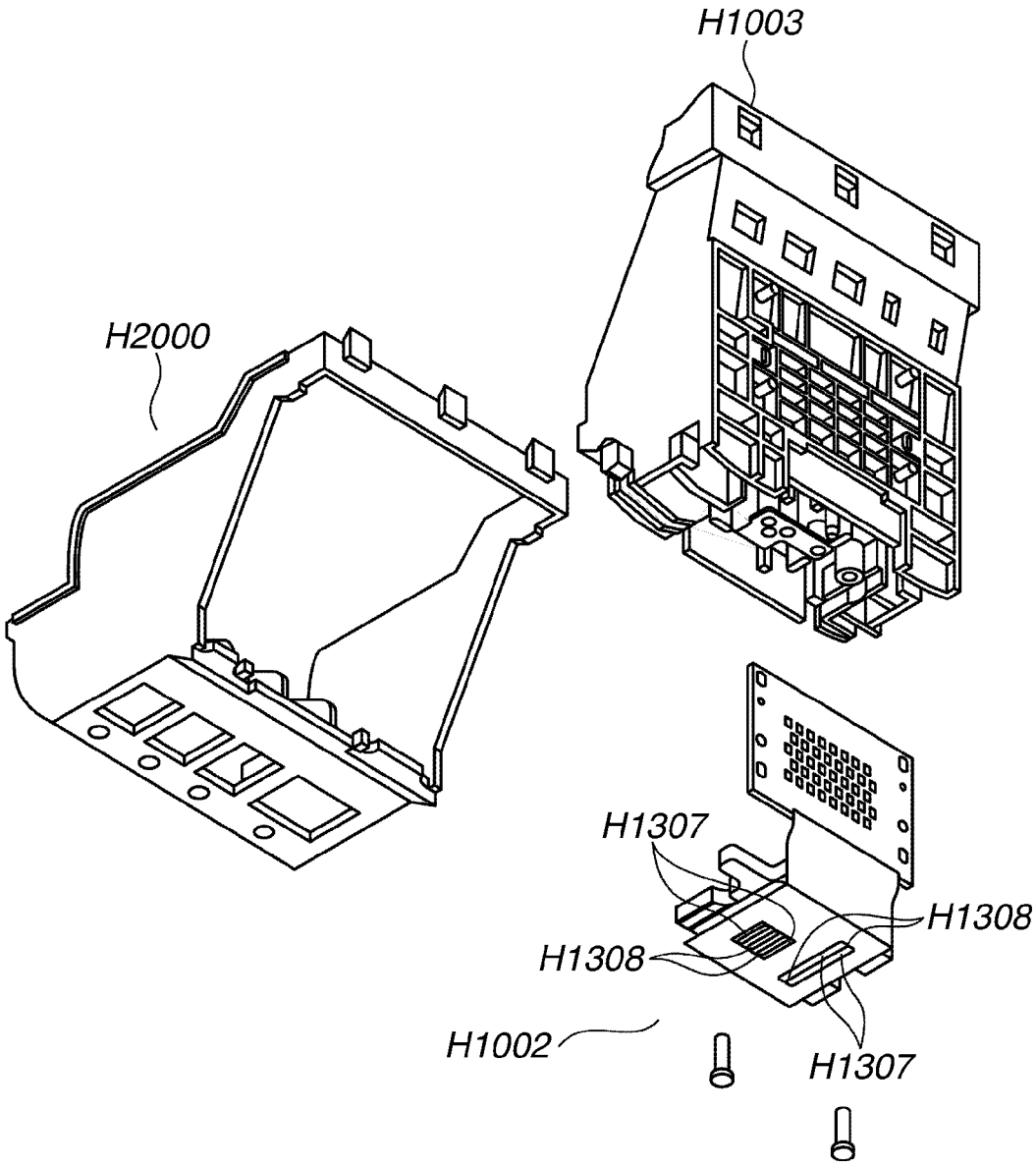
FIG. 3 is an exploded perspective view of the recording head.

FIGS. 2 and 3 are exploded perspective views of the recording head. The recording head according to the present exemplary embodiment is a side-shooter type bubble-jet (registered trademark) recording head that discharges droplets in a substantially vertical direction with respect to a heater substrate. A recording head 130 includes a recording element unit H1002, an ink supply unit H1003, and a tank holder H2000. As illustrated in FIG. 2, the recording element unit H1002 includes a first recording element H1100, a second recording element H1101, a first plate H1200, a second plate H1400, an electric contact substrate H2200, and an electric wiring tape H1300. Further, the ink supply unit H1003 includes an ink supply member H1500, a flow path forming member H1600, a joint rubber H2300, a filter H1700, and a sealing rubber H1800.

Next, the recording element unit H1002 will be described. The recording element unit H1002 is formed in the following order. First, a plate bonded portion (device substrate) is formed by bonding the first plate H1200 to the second plate H1400. Then, the recording element is mounted on the device substrate. Further, after lamination of the electric wiring tape H1300 to the device substrate, the recording element is electrically bonded. Then, the electric connection portion is sealed.

Since the first plate H1200 influences the discharge direction of the droplets, accuracy in flatness of the first plate is required. The first plate H1200 is an alumina ($Al_2O_3$) plate with a thickness of 0.5 mm to 10 mm. On the first plate H1200, there are formed ink supply ports for supplying black ink to the first recording element H1100 as well as ink supply ports for supplying cyan, magenta, yellow, and gray ink to the second recording element H1101.

The second plate H1400 is a piece of plate member with a thickness of 0.5 mm to 1 mm. The second plate H1400 includes openings H1401. The opening H1401 is larger than the outer dimensions of the first recording element H1100 and the second recording element H1101 which are adhered and fixed to the first plate H1200. The second plate H1400 is bonded to the first plate H1200 with an adhesive to form a plate bonded portion.

The first recording element H1100 and the second recording element H1101 include a nozzle array H1104. Further, the recording elements include an ink supply port and a heater array. The ink supply port is a groove-shaped through hole as an ink path formed on a silicon (Si) substrate with a thickness of 0.5 mm to 1 mm. The heater arrays are provided in a staggered arrangement on both sides of the ink supply port. Additionally, the recording elements include electrodes which are arranged orthogonal to the heater array and include a connecting pad connected to the heater. The connecting pad is arranged on the outer side of the substrate.

The electric wiring tape (hereinafter, the wiring tape) H1300 is a tape automated bonding (TAB) tape. A TAB tape is a lamination of a tape base material (base film), copper foil wiring, and a cover layer. As a connection terminal, an inner lead H1302 extends to two sides (connecting sides) of a device hole that corresponds to the electrode of the recording element. The cover layer side of the wiring tape H1300 is bonded to the surface (a tape bonding face) of the second plate H1400 via a connection layer of heat-cured epoxy resin. The base film of the TAB tape has a smooth face to which the cap 522 contacts.

The wiring tape H1300 is electrically connected to the first and the second recording elements H1100 and H1101 respectively by ultrasonic thermal bonding or an anisotropic electro conductive tape. Inner lead bonding (ILB) by ultrasonic thermal bonding is useful for electrically connecting a TAB tape. According to the recording element unit of the present exemplary embodiment, a lead of the wiring tape H1300 and a stud bump on the recording element are bonded by ILB.

After the wiring tape and the recording element are bonded, the electrically-connected portion is sealed with a first sealing compound H1307 and a second sealing compound H1308. This is to protect the electrically-connected portion from corrosion by ink and external impact. The first sealing compound H1307 mainly seals the outer peripheral of the mounted recording element. The second sealing compound H1308 seals the front surface of the electrically-connected portion of the recording element and the wiring tape.

Figure 4:
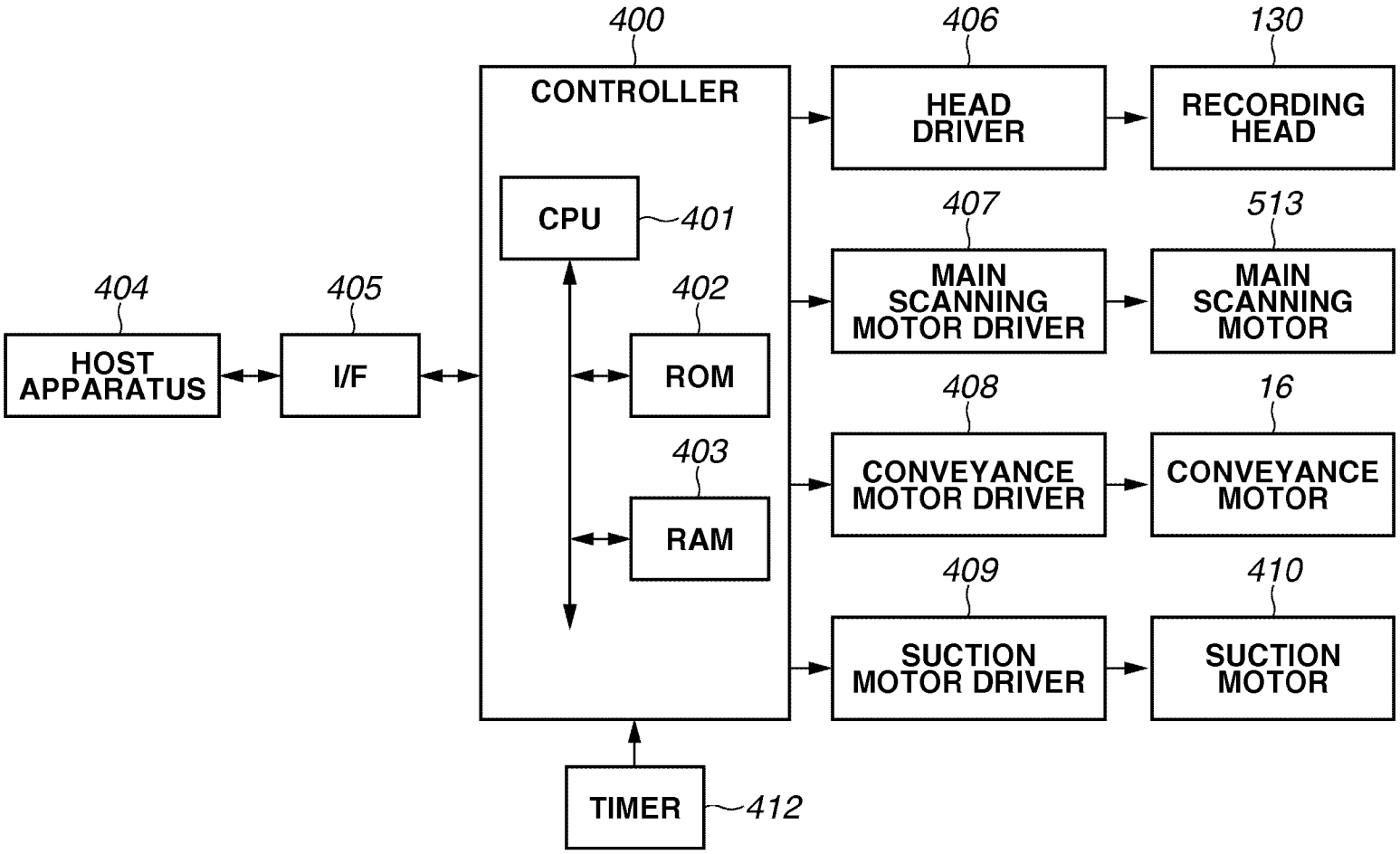
FIG. 4 is a block diagram illustrating a control configuration of the ink jet recording apparatus.

FIG. 4 is a block diagram illustrating a control configuration of the ink jet recording apparatus. A controller 400 controls the whole apparatus by acquiring information from each component of the apparatus and by issuing a command. The controller 400 includes a central processing unit (CPU) 401, a read-only memory (ROM) 402 for storing various programs, and a random access memory (RAM) 403 used as a work area of the CPU 401. The ROM 402 stores tables and stationary data necessary in various types of control as well as the programs. Further, used threshold values regarding a recovery sequence and wait time are also stored in the ROM 402.

A host apparatus 404, which is an external apparatus connected to the recording apparatus, is a supply source of image data. Image data, commands, and status signals are transmitted and received by the controller 400 and the host apparatus 404 via an interface (I/F) 405.

A head driver 406 drives an electric thermal transducing member (discharge heater) provided on each nozzle of the recording head 130 according to discharge data. The recording head 130 according to the present exemplary embodiment discharges ink droplets by an application of a voltage pulse to the electric thermal transducing member. According to the application of the voltage pulse, film boiling of the ink occurs in the nozzle, and the energy of the generated bubble causes the discharge of the ink. However, the discharge method of the present exemplary embodiment is not limited to such a method. If ink can be discharged from each nozzle of the recording head 130 according to a discharge signal, any discharge method can be applied to the present exemplary embodiment.

A main scanning motor driver 407 drives the main scanning motor 513. A conveyance motor driver 408 drives a conveyance motor 16.

A suction motor driver 409 drives a suction motor 410. A timer 412 measures the time elapsed from when the recording head 130 has been capped by the cap 522. The CPU 401 compares the elapsed time obtained from the timer 412 and the various threshold values stored in the ROM 402, and controls a recovery system mechanism according to the result of the comparison.

Ink normally includes a moist component such as water, a solvent, and a moisturizing component such as a moisturizing agent. Thus, a water vapor pressure effect occurs with the ink. The water vapor pressure effect is determined by a mole fraction. In other words, the vapor pressure of water in ink (partial pressure of water vapor) can be calculated according to the following equation (1).

$$\text{Partial pressure of water vapor in ink} = \text{saturated water vapor pressure at measurement temperature} \times \text{mole fraction of water in ink}(\%) \quad (1)$$

On the other hand, humidity generally refers to relative humidity (%). Humidity is obtained by dividing a partial pressure of water vapor included in air at a prescribed temperature by a saturated water vapor pressure at that temperature.

$$\text{Partial pressure of water vapor in air} = \text{saturated water vapor pressure at a prescribed temperature} \times \text{relative humidity}(\%) \quad (2)$$

The ink evaporates or absorbs water so that the partial pressure of water vapor in the ink is in equilibrium with the partial pressure of water vapor in air at the temperature and humidity of that time. It is known that the evaporation speed or the moisture absorption speed to reach the equilibrium is proportional to the difference in the mole fraction of water in ink (%) and the relative humidity (%).

If the mole fraction of water in ink is higher than the relative humidity, the water in the ink evaporates. If the mole fraction of water in ink is lower than the relative humidity, the ink absorbs water in the air and the humidity will be closer to the relative humidity.

Thus, if a recording head that discharges ink of a plurality of colors is capped by a same cap, the amount of water evaporation of the ink in the nozzle changes greatly according to a difference of a few percent of the mole fraction of water in the ink. Normally, the mole fraction of water in ink is higher than the relative humidity. Thus, the density of ink having a relatively high mole fraction of water tends to increase by moisture evaporation. Thus, it is important to control the increase in density of the ink with a relatively high mole fraction of water due to moisture evaporation.

Figure 5:
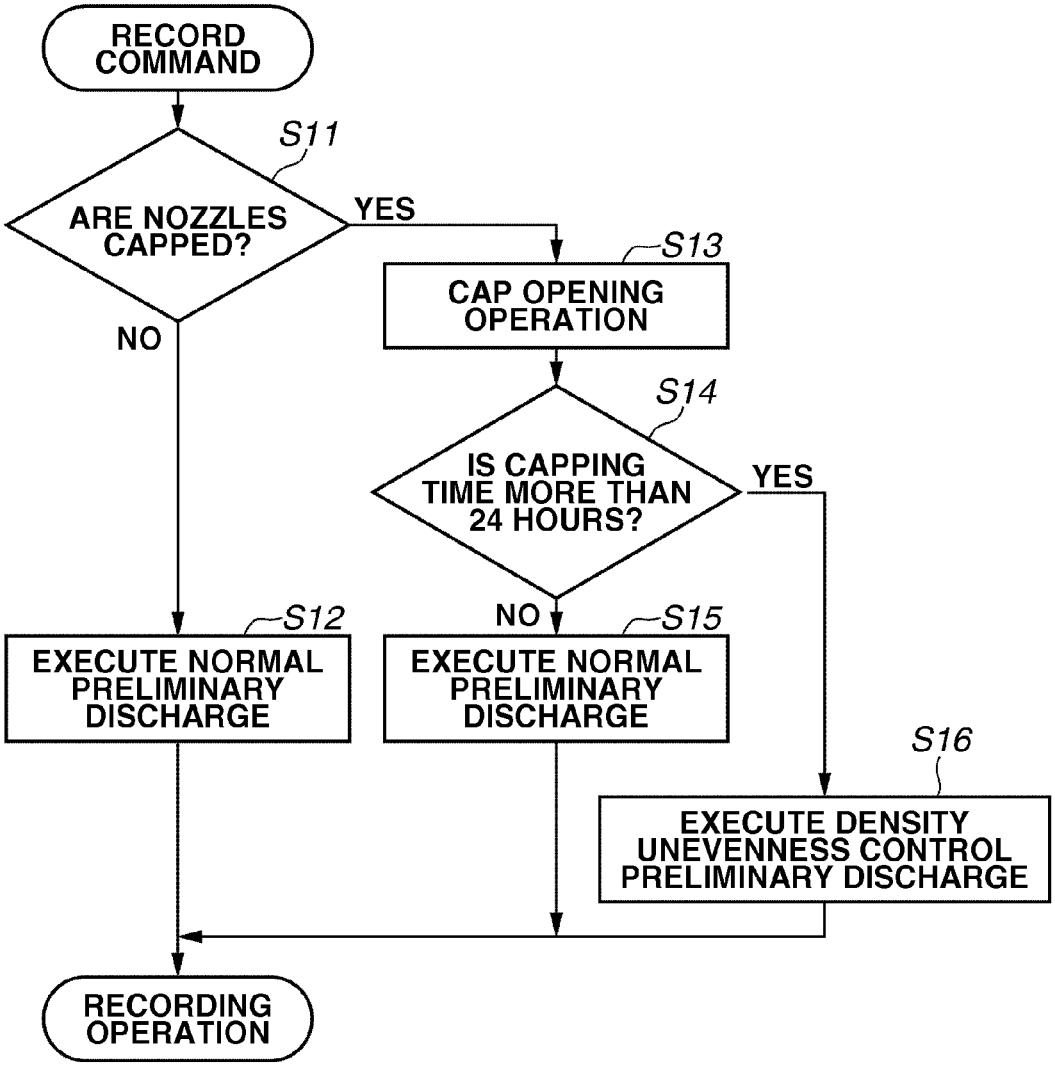
FIG. 5 is a flowchart illustrating a preliminary discharge operation according to a first exemplary embodiment.

FIG. 5 is a flowchart illustrating the preliminary discharge operation according to the first exemplary embodiment. According to the present exemplary embodiment, when a record command is issued, the preliminary discharge operation is changed according to the capping time. According to the present exemplary embodiment, nozzles that discharge ink of cyan, magenta, yellow, and gray colors are capped by a same cap.

When a record command is issued, in step S11, the CPU 401 determines whether the nozzles are capped. If the nozzles are not capped (NO in step S11), the processing proceeds to step S12. In step S12, the CPU 401 executes the normal preliminary discharge operation. If the normal preliminary discharge operation is performed, the same number of ink droplets is discharged from each of the cyan, magenta, yellow, and gray nozzles. According to the present exemplary embodiment, 15 shots of ink are discharged from each of the nozzles. In other words, a preliminary discharge unit, which causes the recording head to perform the preliminary discharge, causes each of the nozzles to discharge the same number of ink droplets in the case of the normal preliminary discharge.

In step S11, if the nozzles are capped (YES in step S11), the processing proceeds to step S13. In step S13, the CPU 401 executes a cap opening operation. According to the cap opening operation, the cap is removed from the discharge port face of the recording head.

After the cap is opened, in step S14, the CPU 401 determines whether the capping time is equal to or more than a predetermined length of time. According to the present exemplary embodiment, the CPU 401 determines whether the capping time is more than 24 hours. The capping time is measured by the timer 412 provided on the electric substrate of the recording apparatus main body.

If the capping time is less than the predetermined length of time (NO in step S14), the processing proceeds to step S15. In step S15, the CPU 401 executes the normal preliminary discharge operation. If the capping time is equal to or more than the predetermined length of time (YES in step S14), the processing proceeds to step S16. In step S16, the CPU 401 executes a density unevenness control preliminary discharge operation. If the density unevenness control preliminary discharge operation is executed, 15 shots of ink are discharged from the nozzles of magenta and yellow ink. Further, 50 shots of ink are discharged from the nozzle of cyan ink, and 100 shots of ink are discharged from the nozzle of gray ink. In other words, if the density unevenness control preliminary discharge is executed, the preliminary discharge unit that causes the recording head to perform the preliminary discharge changes the preliminary discharge operation from the normal preliminary discharge operation.

The reason for increasing the number of discharges of the ink from the cyan and gray nozzles will be described. The mole fraction of water in the cyan, magenta, yellow, and gray ink used is 0.932 for the cyan ink, 0.927 for the magenta ink, 0.929 for the yellow ink, and 0.938 for the gray ink. In other words, the mole fraction of water in the magenta ink as a first ink and the mole fraction of water in the gray ink as a second ink are different. Among the ink of four colors used, the mole fraction of water in the gray ink is relatively high. Thus, if the nozzles are capped for a long time by the same cap, an apparent increase in density occurs with the gray ink due to water evaporation. Accordingly, the quality of the recorded image may be reduced. The cyan ink has the highest mole fraction of water in ink next to the gray ink. Thus, the number of preliminary discharges of the gray ink and the cyan ink are increased compared to the ink of other colors.

According to the present exemplary embodiment, the number of discharges of the preliminary discharge operation is changed according to the value of the mole fraction of water in the ink of different colors. Thus, without increasing the amount of waste ink, the increase in density of the ink can be controlled, and high image quality recording can be realized.

Figure 6:
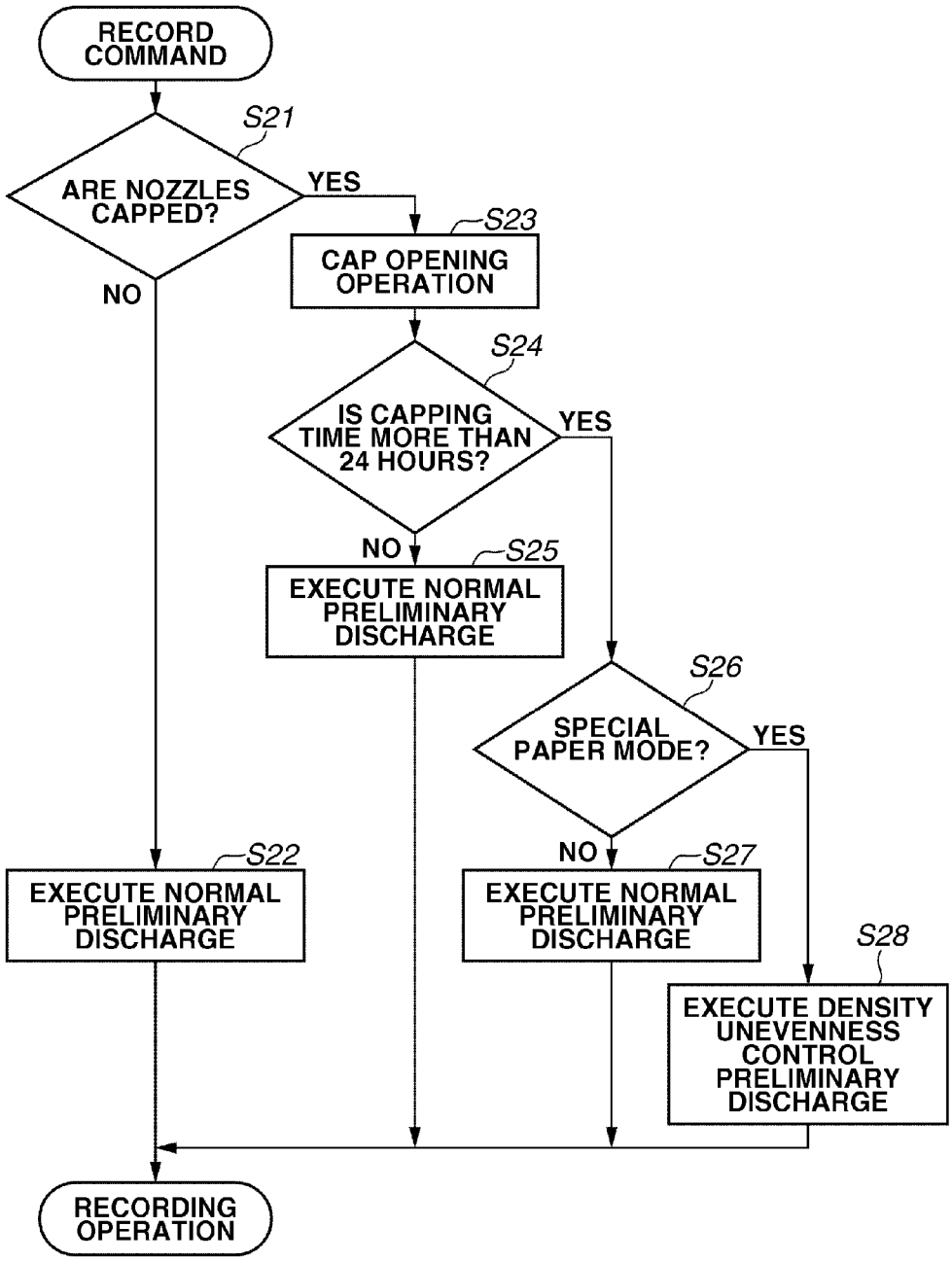
FIG. 6 is a flowchart illustrating a preliminary discharge operation according to a second exemplary embodiment.

FIG. 6 is a flowchart illustrating a preliminary discharge operation according to a second exemplary embodiment. According to the present exemplary embodiment, the preliminary discharge operation is changed according to the capping time and the recording mode. The nozzles according to the present exemplary embodiment which discharge cyan, magenta, yellow, and gray ink are capped by the same cap.

When a record command is issued, in step S21, the CPU 401 determines whether the nozzles are capped. If the nozzles are not capped (NO in step S21), the processing proceeds to step S22. In step S22, the CPU 401 executes the normal preliminary discharge operation. If the normal preliminary discharge operation is performed, as is the case with the first exemplary embodiment, 15 shots of ink are discharged from each of the cyan, magenta, yellow, and gray nozzles.

If the nozzles are capped (YES in step S21), the processing proceeds to step S23. In step S23, the CPU 401 executes the cap opening operation. After the cap is opened, in step S24, the CPU 401 determines whether the capping time is equal to or more than a predetermined time. According to the present exemplary embodiment, the CPU 401 determines whether the capping time is more than 24 hours.

If the capping time is less than the predetermined length of time (NO in step S24), the processing proceeds to step S25. In step S25, the CPU 401 executes the normal preliminary discharge operation. If the capping time is equal to or more than the predetermined length of time (YES in step S24), the processing proceeds to step S26. In step S26, the CPU 401 determines whether the recording mode is a special paper mode. If the recording mode is not the special paper mode (NO in step S26), the processing proceeds to step S27. In step S27, the CPU 401 executes the normal preliminary discharge operation. If the recording mode is the special paper mode (YES in step S26), the processing proceeds to step S28. In step S28, the CPU 401 executes the density unevenness control preliminary discharge operation. If the density unevenness control preliminary discharge operation is executed, as is the case with the first exemplary embodiment, 15 shots of ink are discharged from the nozzles of magenta and yellow ink, 50 shots of ink are discharged from the nozzle of cyan ink, and 100 shots of ink are discharged from the nozzle of gray ink.

According to the present exemplary embodiment, the preliminary discharge operation is changed based on the recording mode. This is because image unevenness is more easily recognized when the recording mode is the special paper mode. Thus, when the recording mode is the special paper mode, the density unevenness control preliminary discharge operation is executed. On the other hand, if the recording mode is not the special paper mode, in other words, if the mode is a plain paper mode, the image unevenness is less recognizable. Thus, the normal preliminary discharge operation is executed to prevent the amount of waste ink from increasing.

According to the present exemplary embodiment, since the preliminary discharge operation is changed according to the capping time and the recording mode, high image quality recording can be realized without increasing the amount of waste ink.

A third exemplary embodiment will be described with reference to FIG. 7. According to the present exemplary embodiment, one nozzle array of the recording head includes 512 nozzles. When an image of high image quality such as a photograph image is recorded, multipass recording is performed. In the multipass recording, a plurality of times of recording operation is performed on a same area of a recording medium using a different nozzle. For example, in the case of two-pass recording, the amount of paper feed for one paper feed is set to a length corresponding to 256 nozzles, whereas in the case of four-pass recording, the amount of paper feed for one paper feed is set to a length corresponding to 128 nozzles.

In the case of four-pass recording of a center area (area excluding the leading end and the trailing end areas) of a recording medium in the conveyance direction, since the recording is performed using all the 512 nozzles, the amount of conveyance at a time is the length corresponding to 128 nozzles. Since the image formation is completed by four times of scanning, one block corresponds to 128 nozzles at the center area.

If the leading end area of the recording medium is recorded by four-pass recording, since only 128 nozzles are used for the recording, the amount of conveyance at a time will be a length corresponding to 32 nozzles. Since the image formation is completed by four times of scanning, one block corresponds to 32 nozzles at the leading end area.

An area shifting from the leading end area to the center area is referred to as a transitional area. The number of nozzles to be used is gradually increased as the recording area nears the center area. The recording operation from the leading end area to the center area via the transitional area will be described with reference to FIG. 7.

Figure 7:
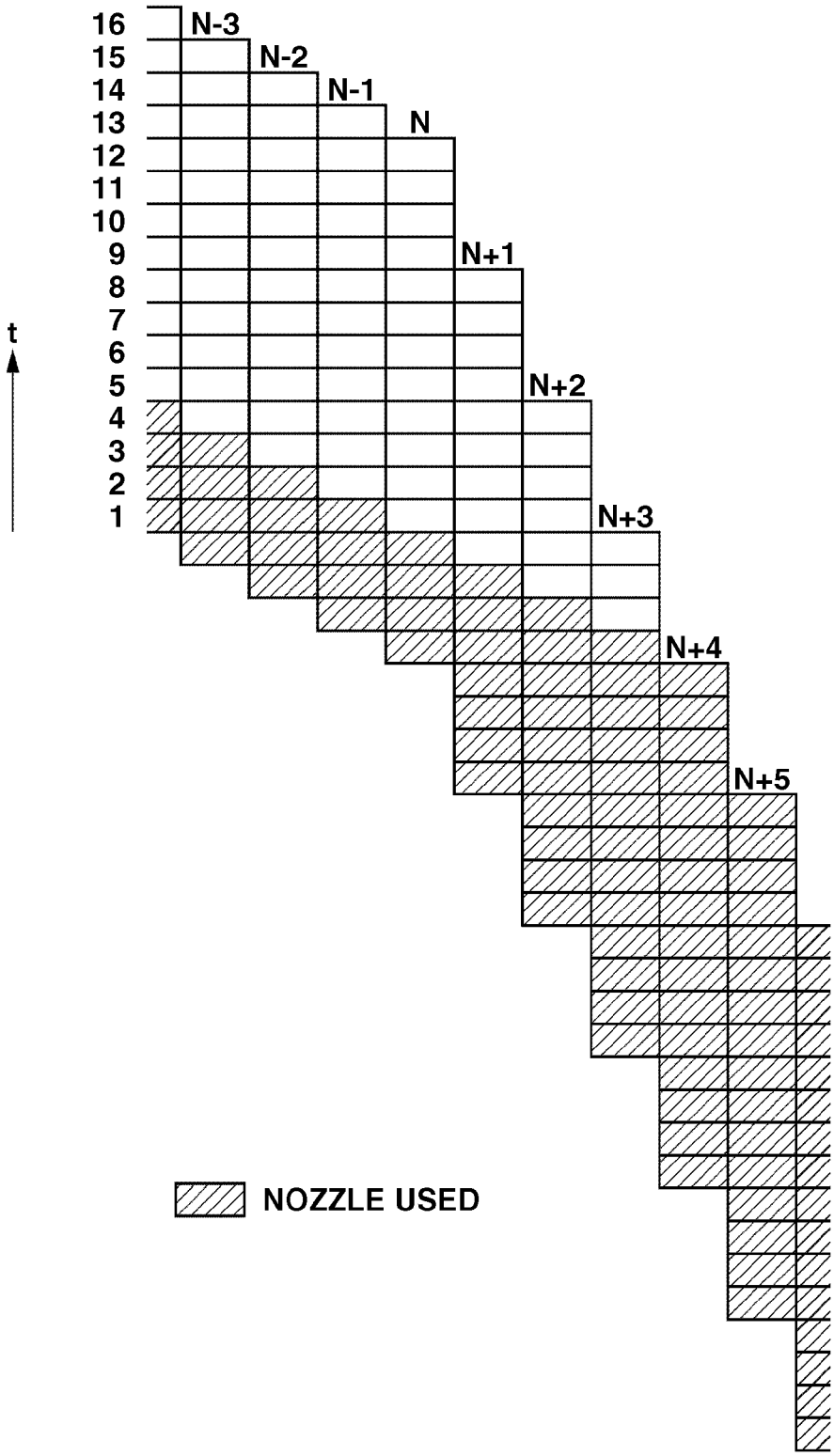
FIG. 7 illustrates a positional relation of nozzles when recording of a recording medium from the leading end area to the center area is performed.

FIG. 7 illustrates a positional relation of the nozzles which are used when the recording is performed from the leading end area to the center area of a recording medium. In FIG. 7, an arrow "t" indicates the conveyance direction of the recording medium. Further, a total of 16 nozzles are used in FIG. 7 for ease of description. The nozzles in the nozzle array are numbered such that the first nozzle is on the upstream side of the conveyance direction and the 16th nozzle is on the downstream side. The center area is subjected to four-pass recording of one block that includes four nozzles. On the other hand, the leading end area is recorded by four nozzles from the first to the fourth nozzles on the upstream side of the conveyance direction of the recording medium. The leading end area is subjected to four-pass recording of one block that includes one nozzle.

In FIG. 7, the leading end area is recorded by scanning (N−3) to (N). As described above, the recording is performed by the first to the fourth nozzles. The amount of conveyance corresponds to one nozzle at a time. For example, the area recorded by the first nozzle by the scanning (N−3) is recorded again by the second nozzle by the next scanning (N−2). Further, the same area is recorded by the third nozzle by the scanning (N−1) and by the fourth nozzle by the scanning (N).

The recording of the leading end area is finished by the scanning (N). The amount of conveyance from the scanning (N) to the scanning (N+1) corresponds to the length of four nozzles. The amount of conveyance of subsequent scanning will be 4 nozzles. Regarding the (N+1) scanning, the fifth to the seventh nozzles, which are not used up to the scanning (N), are additionally used for the recording. Accordingly, a total of seven nozzles are used for the recording. Similarly, regarding the scanning (N+2), the eighth to the tenth nozzles are additionally used for the recording. Accordingly, a total of 10 nozzles are used for the recording. Regarding the scanning (N+3), the 11th to the 13th nozzles are additionally used for the recording. Accordingly, a total of 13 nozzles are used for the recording. Further, regarding the scanning (N+4), the 14th to the 16th nozzles are additionally used for the recording. Accordingly, all the 16 nozzles are used for the recording. On and after the scanning (N+5), the recording is performed by using all the 16 nozzles.

At the transitional area from the leading end area to the center area, the state of the ink in the nozzle differs greatly between the nozzle which has been used and the nozzle which is used for the first time. According to the nozzle which has already been used, since ink of a normal density is supplied from the ink tank, there is no need to control the increase in density. However, when a new nozzle is used for the first time, the density increase needs to be considered.

Thus, according to the present exemplary embodiment, the nozzles which are used for recording from the leading end of the recording medium are controlled in such a manner that the number of the preliminary discharges of such nozzles is reduced compared with other nozzles. To be more precise, when the density unevenness control preliminary discharge operation is performed, regarding the center nozzle to the downstream side nozzle, 15 shots of ink are discharged from the nozzles of magenta and yellow ink, 50 shots of ink are discharged from the nozzle of cyan ink, and 100 shots of ink are discharged from the nozzle of gray ink. On the other hand, regarding the upstream nozzles which are used in recording the leading end area, 15 shots of ink are discharged from the nozzles of magenta and yellow ink. Further, 25 shots of ink are discharged from the nozzle of cyan ink. This is half the number of discharges of the ink discharged from the center to the downstream side nozzles. Similarly, 50 shots of ink are discharged from the nozzle of gray ink.

According to the present exemplary embodiment, since the number of preliminary discharges from the nozzles used for recording the leading end area can be reduced, the amount of waste ink can also be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-161441, filed Jul. 23 2011, which is hereby incorporated by reference herein in its entirety.

What is claimed is:

1. An inkjet recording apparatus comprising:

a recording head including a discharge port face provided with a first discharge port configured to discharge a first ink and a second discharge port configured to discharge a second ink of which a mole fraction of water is higher than the first ink;

a cap configured to cap the discharge port face;

a measurement unit configured to measure a capping time in which the discharge port face is capped by the cap; and a preliminary discharge unit configured to cause the recording head to execute a preliminary discharge, wherein the preliminary discharge unit causes the recording head to execute the preliminary discharge in a manner such that a same amount of ink is discharged from the first discharge port and the second discharge port in a case where the capping time measured by the measurement unit is shorter than a predetermined time, and causes the recording head to execute the preliminary discharge in a manner such that a larger amount of ink is discharged from the second discharge port than from the first discharge port in a case where the capping time is equal to or longer than the predetermined time.

2. The inkjet recording apparatus according to claim 1, further comprising a determination unit configured to determine whether a recording mode is a special paper mode, wherein the preliminary discharge unit causes the recording head to execute the preliminary discharge in a manner such that a same amount of ink is discharged from the first discharge port and the second discharge port even if the capping time is equal to or longer than the predetermined time in a case where the determination unit determines that a recording mode is not the special paper mode.

3. The inkjet recording apparatus according to claim 1, wherein the recording head uses a part of nozzles in recording a leading end area of a recording medium and uses all nozzles in recording a center area of the recording medium, wherein the preliminary discharge unit changes the preliminary discharge operation according to a position of a nozzle of the recording head.

4. The inkjet recording apparatus according to claim 3, wherein the preliminary discharge unit increases a number of discharges from a nozzle that is not used in recording the leading end area as compared to a number of discharges from a nozzle that is used in recording the leading end area.

5. The inkjet recording apparatus according to claim 1, wherein the first ink is magenta ink or yellow ink.

6. The inkjet recording apparatus according to claim 5, wherein the second ink is cyan ink or gray ink.

7. The inkjet recording apparatus according to claim 6, wherein, in a case where the recording head executes the preliminary discharge when the capping time is equal to or longer than the predetermined time, the amount of ink discharged from the first discharge port is equal to an amount of ink discharged from the first discharge port and an amount of ink discharged from the second discharge port in a case where the recording head executes the preliminary discharge when the capping time is shorter than the capping time.

8. The inkjet recording apparatus according to claim 1, wherein the first ink is cyan ink and the second ink is gray ink.

9. The inkjet recording apparatus according to claim 8, wherein, in a case where the recording head executes the preliminary discharge when the capping time is equal to or longer than the predetermined time, the amount of ink discharged from the first discharge port is larger than an amount of ink discharged from the first discharge port and an amount of ink discharged from the second discharge port in a case where the recording head executes the preliminary discharge when the capping time is shorter than the capping time.

10. A preliminary discharge method for an inkjet recording apparatus having a recording head including a discharge port face provided with a first discharge port configured to discharge a first ink and a second discharge port configured to discharge a second ink of which a mole fraction of water is higher than the first ink and a cap configured to cap the discharge port face, the preliminary discharge method comprising:

measuring a capping time in which the discharge port face is capped by the cap; and causing the recording head to execute a preliminary discharge, wherein causing includes causing the recording head to execute the preliminary discharge in a manner such that a same amount of ink is discharged from the first discharge port and the second discharge port in a case where the measured capping time is shorter than a predetermined time, and causes the recording head to execute the preliminary discharge in a manner such that a larger amount of ink is discharged from the second discharge port than from the first discharge port in a case where the capping time is equal to or longer than the predetermined time.

* * * * *